US011346151B1

(12) United States Patent
Davis

(10) Patent No.: US 11,346,151 B1
(45) Date of Patent: May 31, 2022

(54) HINGE STILE GAP BLOCKING APPARATUS

(71) Applicant: Raymond E Davis, Heath, TX (US)

(72) Inventor: Raymond E Davis, Heath, TX (US)

( * ) Notice: Subject to any disclaimer, the term of this patent is extended or adjusted under 35 U.S.C. 154(b) by 0 days.

(21) Appl. No.: 17/346,341

(22) Filed: Jun. 14, 2021

(51) Int. Cl.
*E06B 7/36* (2006.01)
*E05D 11/00* (2006.01)

(52) U.S. Cl.
CPC ..... *E06B 7/367* (2013.01); *E05D 11/0054* (2013.01); *E05D 2011/0072* (2013.01); *E05Y 2800/41* (2013.01)

(58) Field of Classification Search
CPC ..... E06B 7/367; E06B 7/36; E05D 11/0054; E05D 2011/0072; E05Y 2800/41
See application file for complete search history.

(56) References Cited

U.S. PATENT DOCUMENTS 4,878,267 A * 11/1989 Roach ..... E06B 7/367 16/250
7,861,465 B1 * 1/2011 Christ ..... E06B 7/367 49/506
9,803,419 B2 * 10/2017 Izod ..... E06B 7/36
2004/0107647 A1 * 6/2004 Salzman ..... E06B 7/367 49/462
2006/0026793 A1 * 2/2006 Li ..... E06B 7/367 16/82
2016/0090768 A1 * 3/2016 Mooers ..... E05D 11/0054 16/251
2016/0245015 A1 * 8/2016 Davis ..... E06B 7/367

* cited by examiner

*Primary Examiner* — Justin B Rephann
(74) *Attorney, Agent, or Firm* — Baker Law; John Baker; Jeffrey Roddy

(57) ABSTRACT

This invention relates to a hinge stile gap blocking apparatus and to a method designed to prevent hand and finger injuries resulting from inadvertent door closures. The apparatus includes a pair of joined elongate members, each elongate member is joined to the other by an elastic band which extends through the opening of a door frame hinge stile gap with each joined elongate member residing on opposite sides of the hinge stile gap. The elongate members move when the door is pivoted, but are sufficiently tensioned against the hinge stile such that hands and fingers cannot be placed in the hinge stile gap when the door is open.

1 Claim, 10 Drawing Sheets

FIG. 7
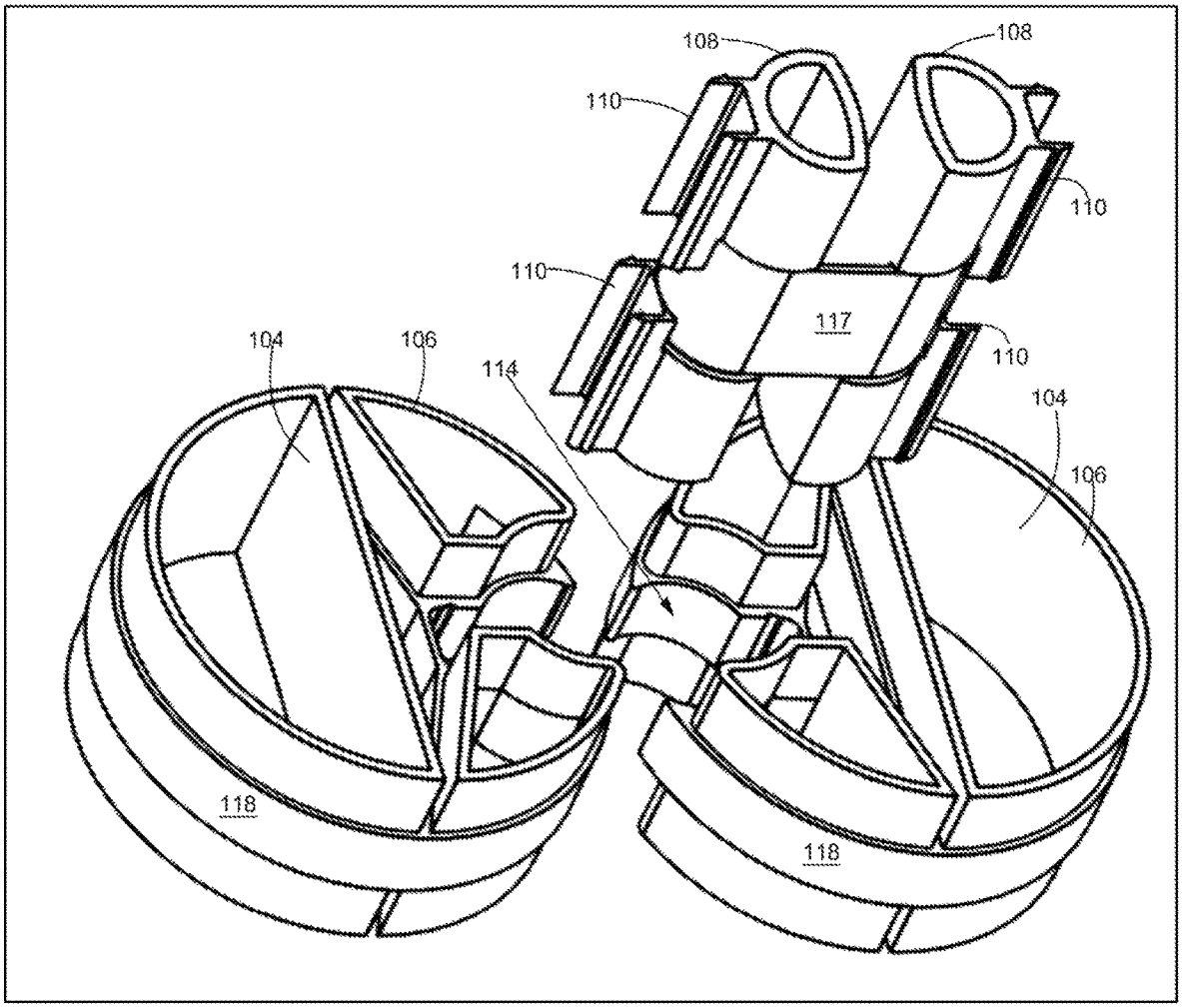
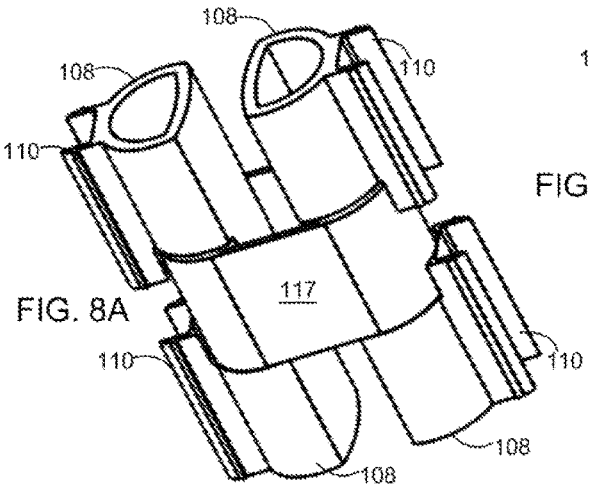
FIG. 8A
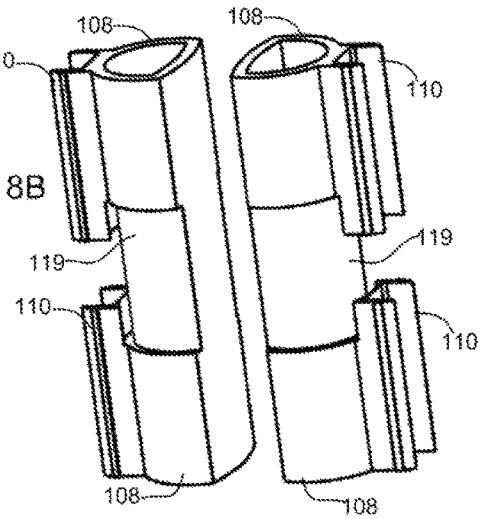
FIG. 8B

HINGE STILE GAP BLOCKING APPARATUS

FIELD OF THE INVENTION

This invention relates to the field of injury prevention devices and more particularly, devices and methods to insure the safe operation of doors.

BACKGROUND OF THE INVENTION

The open area of a door hinge frequently attracts the eyes and exploring fingers of small children and accounts for 55% of door related injuries. If the door closes while fingers are within this area, as much as 40 tons of pressure per square inch is created easily crushing or pulverizing human tissue, and amputating fingers.

It has been reported that according to the National Safety Council—Injury Facts 2011 Edition; U.S. Consumer Product Safety Commission's National Electronic Injury Surveillance System, that approximately 380,800 door related injuries occur in the United States every year. Door related injuries occur at a rate of 31,000 month, 1,000 every day, 42 every hour and 1 every 1.4 minutes. According to one study; Clinical Pediatric Study: "Children Treated in the United States Emergency Departments for Door-related Injuries, 1999-2008", approximately eighty percent of door-related injuries occur to children in the home and approximately forty two percent of these children were under the age of four. Thousands of children every year are sent to the hospital with fractures, crushed and pulverized tissue or broken bones because portions of fingers and hands were caught in slamming doors.

According to a study published in the January 2010 edition of the Journal of Trauma, more than 950 children visited emergency rooms in 2003 for traumatic amputations.

Door injuries are very serious, disastrous, and potentially life changing. Amputations are a triple threat involving loss of function, loss of sensation, and loss of body image causing postoperative complications such as psychological problems, phantom pain, adverse emotional health, and needed psychosocial support. Individuals who earn their living from motor skills are especially vulnerable to amputations. Amputation in the preadolescent or adolescent age group is a great threat to emerging self image and sexual identity, and elderly amputees are at a greater risk for psychiatric disturbances such as depression, social isolation, financial difficulties, and occupational limitations which complicate the adjustment to serious door hand injuries or finger amputations.

The true incidence of door-related injuries is underestimated because not all door related injuries are treated in hospital Emergency Departments and urgent care centers do not report statistics. Of the reported cases, tens of thousands of door related injuries result in finger amputations to children. Even one door injury is too many. Embodiments of the present invention can prevent most if not all of this type of injury.

The present invention will not only prevent injury to children by unintended door closings, but will mitigate real potential legal and financial liability to many public and private facilities. There are many potential legal theories under which these public and private facilities having known and foreseeably unsafe doors can be found legally liable for these injuries including: premises liability, landowner-occupier duties, general negligence, attractive nuisance doctrine, and products liability. For example, under the attractive nuisance doctrine, where the trespass of a child is likely, a landowner owes a duty to exercise ordinary care to avoid a foreseeable risk of harm posed by known dangerous artificial conditions, which result from the child's inability to appreciate the risk of harm. Many heavy commercial doors in commercial buildings readily attract children. Some of these doors and door surrounds have attractive shiny metallic finishes or bright colored paint baiting the eyes and fingers of child. Doors are easily accessible to the exploring fingers of young children who are unable to appreciate the dangerous condition.

Liability under the attractive nuisance doctrine can be imposed as there now exists the inventor's known door hinge safety device which can be installed at a small cost compared to the overall door installation. Thus, the cost of eliminating the known dangerous artificial condition of the finger amputating door is not so burdensome and this duty to install should be afforded even with respect to child trespassers.

Landowner or occupier liabilities can be found significantly more easily than under the attractive nuisance doctrine since landowners or occupier liability extends to licensees and/or invitees when they are injured in the face of known and foreseeable risks posed to them.

DESCRIPTION OF PRIOR ART

Major problems facing current users of door safety closure prevention devices is that many such devices require modifications to door or door frame construction. Moreover, such devices do not fully and effectively occlude a door hinge gap when the door is transitioned from an open position to a closed position and from a closed position to an open position sufficient to prevent hands and fingers from being crushed, injured, or amputated. Further, many door safety closure prevention devices are just movable stops that many times get displaced from their original intended position and fail to prevent a door from closing.

For at least the foregoing reasons, there is a need for a door safety closure device that will prevent hands and fingers from being crushed, injured, or amputated within the hinge area of the door and door surround. Moreover, the invention will prevent the economic loss of serious door injuries resulting from loss of livelihood, increased government disability payments, and diminished functional capacity of the amputees. Further, the invention will mitigate financial and legal liability that is created under legal causes of action filed under premise liability, landowner-occupier liability, general negligence, attractive nuisance doctrine, or products liability law suits.

SUMMARY

The present invention is directed to a hand and finger door protector for residential and commercial doors that will protect hands and fingers from being crushed, injured, or amputated in a hinge gap of the door and door surround by the unintended slamming or closing of the door. Embodiments of this invention are designed to be used with any type of pivoting door and occlude the hinge gap of the door at all times and at all door positions.

The apparatus and method disclosed herein prevents injury to body parts resulting from door closure. The apparatus and method described herein achieve injury prevention by the steps of mounting to a door frame a specially shaped apparatus that includes portions that occlude the hinge stile gap of a door when opening or closing the door. More specifically, the hinge stile gap blocking apparatus includes a pair of elongate members that are joined side by side along their length and each elongate member of the pair is configured for mounting to opposite sides of a hinge stile gap. The elongate members completely span the hinge stile gap from the hinge stile of the door to the door frame casing, so that fingers cannot pry around the elongate members and thus risk exposure to the hinge gap of the door.

The elongate members are attached to the opposite outside edges of the door hinge stile and the door casing, and the elongate members are tensionably connected one to another along their length via elastic members that in some implementations are rubber bands. Once the apparatus is installed, the hinge stile gap—both the hinge barrel side and the opposite side one either side of the door frame—are effectively blocked such that fingers can't be placed around the elongate members and into the gap where injury could occur. When the door is pivoted on its hinges, the elastic connectors permit the elongate members to shift slightly, yet still remain firmly against the hinge stile line. In some implementations, a longitudinal cove formed in the elongate members is adapted to receive and nest the pin barrels so that areas of the elongate members adjacent to the longitudinal cove may be in contact with the surrounding areas of the hinge stile, that is, the door edge and door frame.

FACTORS AND ASPECTS OF THE INVENTION

First, the inventor is not aware of existing hand and finger door safety devices that occlude the hinge stile gap of a door in the manner of the present invention.

Second, embodiments of this invention include mounting means that include one or more mounting portions which may be engaged with portions of a door jamb such as hinge barrels.

Third, embodiments of the apparatus may possess one or more connectable sections for spanning the distance of an inner door frame between hinges, or, one or more sections that overlay the hinge stile gap to include the hinge barrels.

Fourth, embodiments of the present invention may include a means to produce multiple sections; e.g., by severing, sawing or separating smaller sections from a larger section wherein the smaller sections are custom fitted to span the distance of an inner door frame between hinges, or, include pre-sized section(s) that overlay a hinge to provide a continuous outwardly facing section of a hinge stile gap blocking apparatus.

The foregoing and other objects, features, and advantages of the invention will become more apparent from the following detailed description, which proceeds with reference to the accompanying figures wherein the scale depicted is approximate.

BRIEF DESCRIPTION OF THE DRAWING FIGURES

FIG. 7 is another exploded view thereof;

FIG. 8A is a perspective view of a clip pair that includes an elastic band;

FIG. 8B is another perspective view thereof of a clip pair without the elastic band;

REFERENCE LISTING OF THE NUMBERED ELEMENTS

Figure 1:
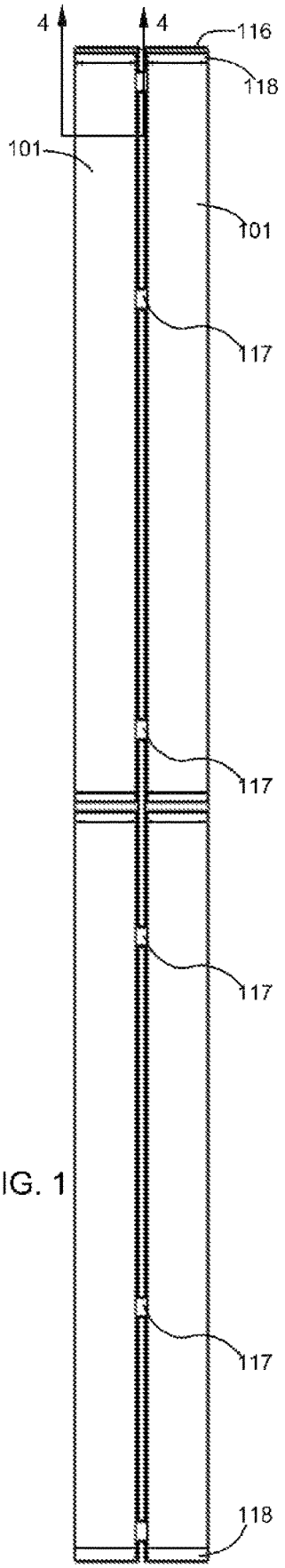
FIG. 1 is a side view of an example hinge guard assembly according to the present invention.

100 hinge guard
101 elongate member
102 support rib
104 coupling rib
106 annular coupling
108 clip
110 clip prongs
112 band annulus
114 clip slot
116 cap
117 band
118 friction ring
119 band slot
120 door
121 door hinge
122 door hinge stile
123 door jamb
124 door gap
125 hinge barrel slot
126 hinge barrel
130 hinge stile gap

DEFINITIONS

In the following description, the term "door" as used herein, includes pivoting or hinging panels that are designed to occlude a doorway. The term "complete door closure" as used herein, means the edge of the door is substantially flush with a door surround and wherein there is minimal gap between the edges of the door and the frame. The term "door surround" as used herein, means the structure surrounding a door, whether outward facing or inward facing, and includes raised molding (casing), or other non-raised surface, e.g., wall or cabinetry surfaces directly adjacent to—or abutting the door's edge(s). The term "door jamb" as used herein, refers to portions of the door frame that are typically at a right angle relative to the casing of the door when the door is shut. The term "leading edge" also known as the "shutting stile," refers to that portion of a door that leads when the door is being moved from an open to closed position; e.g., the lock stile of a rail and stile door. The term "hinge stile" refers to the vertical portion of a door edge to which hinges are affixed and about which the door pivots. The term "hinge stile gap" refers to the gap created between the back edges of a door and a door frame when the door is partially or wholly opened. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1-13, embodiments according to the present invention for a hinge stile blocking apparatus and a method for preventing injuries resulting from insertion of hands and fingers into a hinge stile gap 130 of a door 120 include, a door hinge stile gap blocker apparatus 100 depicted herein, includes a pair of elongate members 101 that may be substantially cylindrical or another shape that will suitably block a hinge stile gap when a door is not fully closed. Each elongate member of a pair of elongate members are connected one to another via a number of spaced elastic bands 117. Typically, the elongate members include sections that are coaxially connected via annular couplings 106 and friction rings 118 disposed between the sections. Annular couplings 106 include reinforcement portions such as coupling rib 104 and clip slot 114 which is adapted to seat a clip 108 via clip prongs 110. Elongate members 101 include a longitudinal slot 125 adapted to receive a hinge barrel 126. Clips 108 are typically paired and a band placed over band slots 119 (FIG. 8B), and the clip prongs 110 interlock with the clip slot 114 of couplers 106. Accordingly, when the apparatus 100 is mounted to a door jamb 123, the respective elongate members 101 reside on either side of the door frame and the band 117 bridge between the two elongate members residing there when the door is open or closed, the bands being of a thickness that will not interfere with fully closing the door.

Implementations of the hinge stile gap blocking apparatus 100 may be retrofitted to an existing door 120 and door jamb 123, or, may be pre-installed on pre-hung doors. Alternately, certain implementations of the apparatus may be provided in a kit form suitable for home or commercial use. It is even conceivable that the hinge stile blocking apparatus be incorporated into wood, plastic or metal commercial door frames at the time of manufacture.

Figure 2:
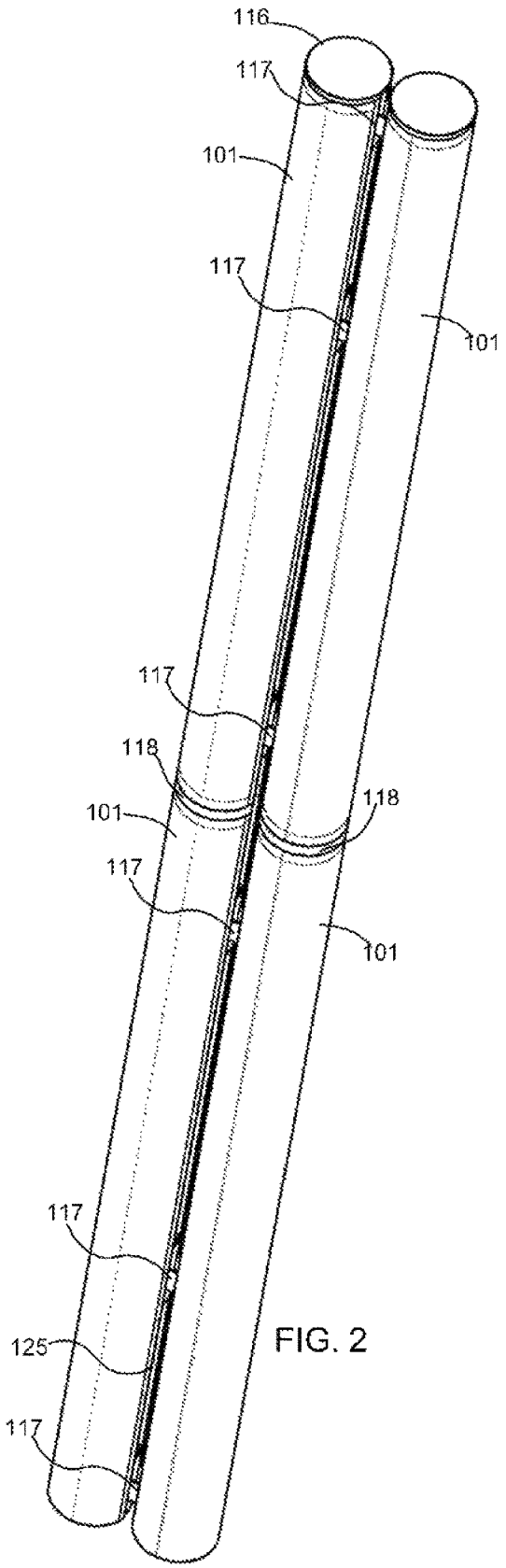
FIG. 2 is a perspective view of the hinge guard assembly shown in (FIG. 1)

FIGS. 1 and 2 show respectively, a side elevation and perspective view of an example hinge stile blocking assembly that includes two elongate members 101 joined side by side by elastic bands 117. The elongate members typically are divided into sections that are coaxially connectable via annular couplings 106 that are mountable at the ends of the sections. The couplings include a slot for receiving a clip 108 so that when the elongate members are aligned side-by-side the corresponding couplers and clips are likewise aligned. Mounted to each clip, a band 117 bridges and connects the clips of the paired elongate members.

Figure 3:
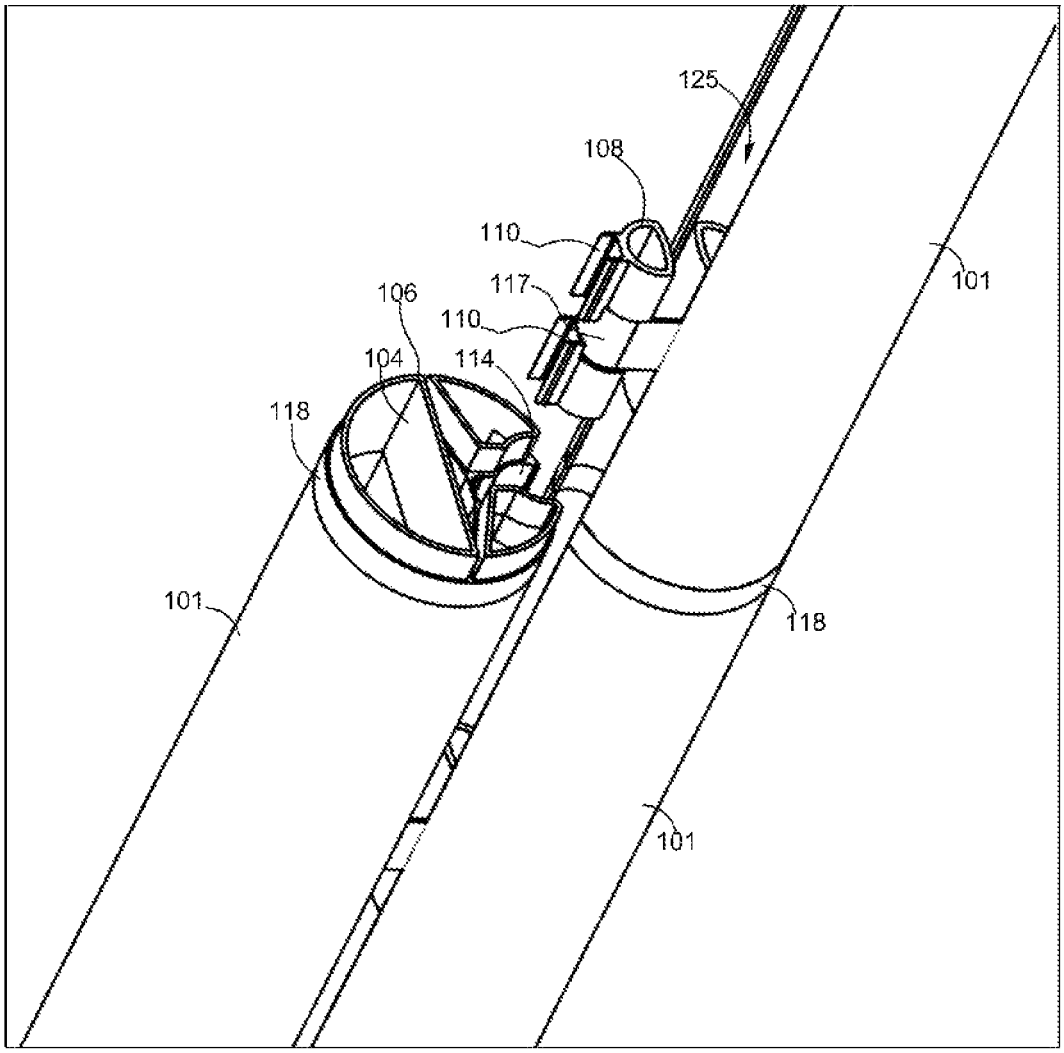
FIG. 3 is a perspective view showing a example arrangement of components of a hinge guard assembly.

FIG. 3 is an enlarged detail view showing an example arrangement of the various elements of the a hinge stile blocking assembly 100 that include elongate members 101, coaxially connectable by mounting couplers 106 between sections. In the figure, a clip pair 108 is disposed within hinge barrel slot 125

Figure 4:
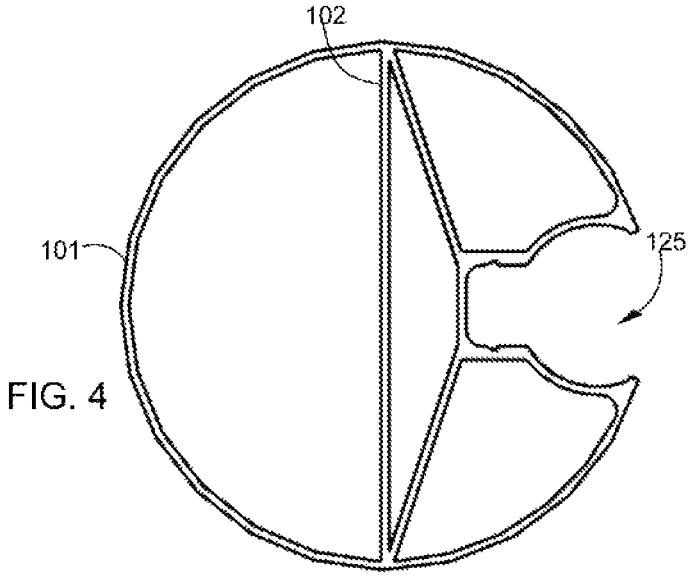
FIG. 4 is a cross-sectional view taken along lines 4-4 of (FIG. 1)

FIG. 4 is a cross-sectional view taken along lines 4-4 of (FIG. 1) of an exemplary elongate section 101 with a longitudinal cove/slot 125 that receives clips 108 allows the slidable passage of the clips and serves to partially enclose the hinge barrels of a door jamb 123.

Figure 5:
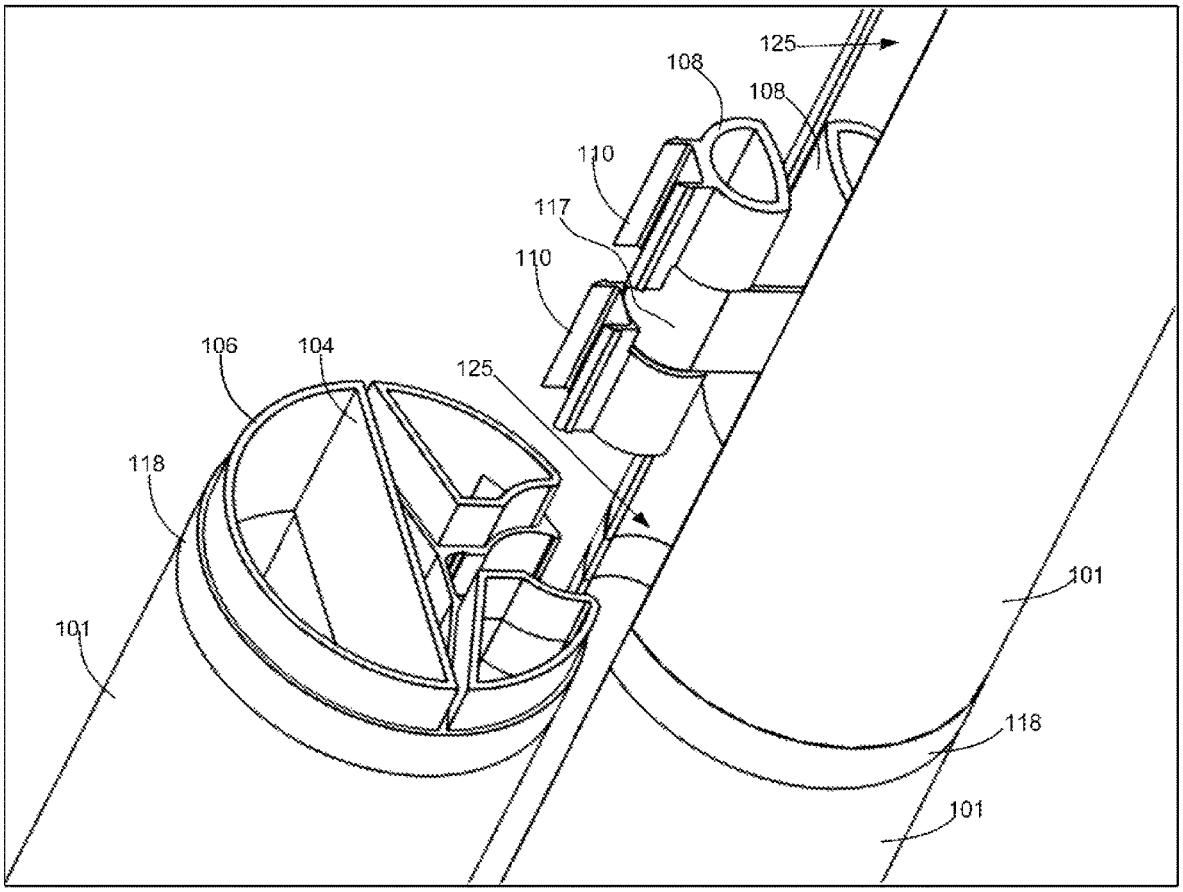
FIG. 5 is an enlarged detail view thereof.
Figure 6:
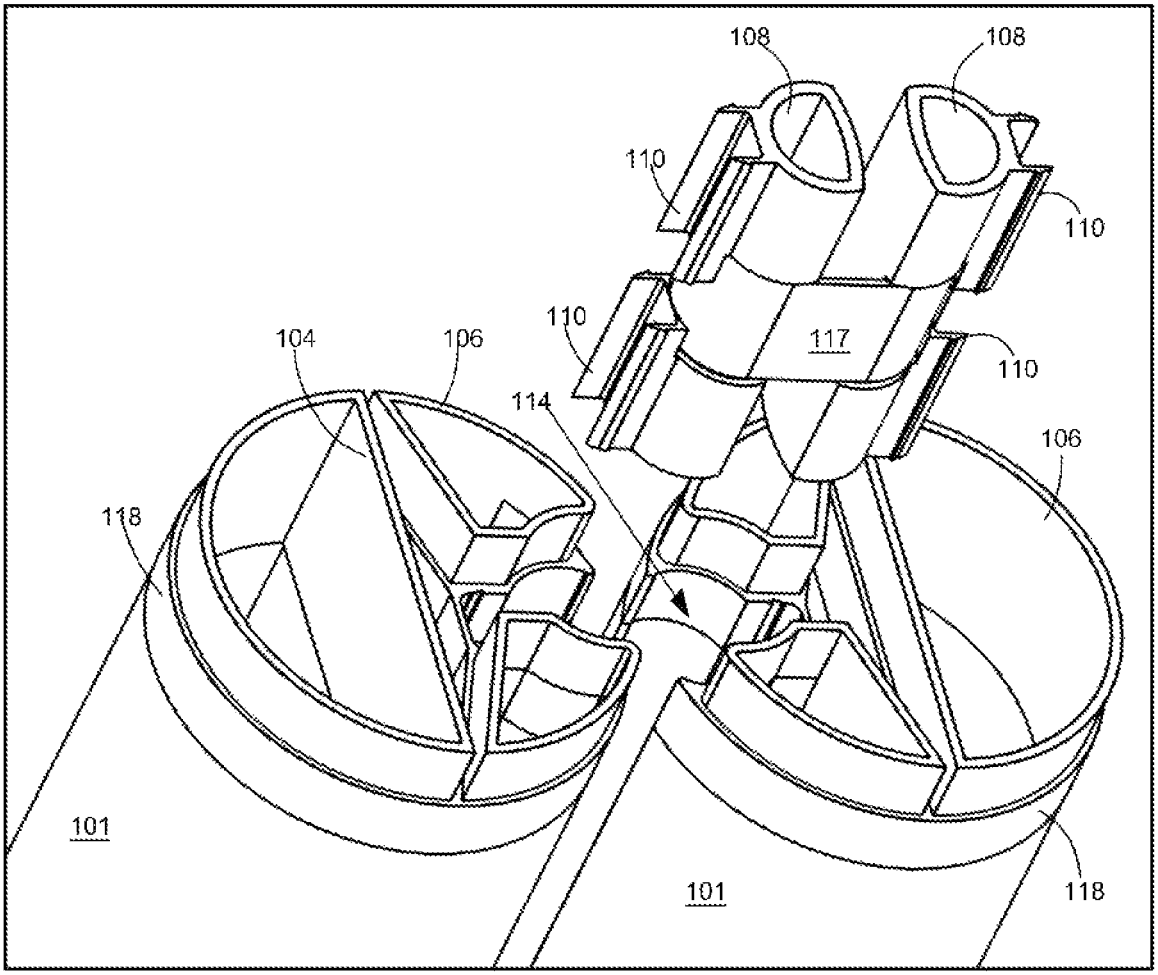
FIG. 6 is an exploded view thereof.

FIG. 5 is an enlarged detail view of the arrangement of elements shown in (FIG. 3). FIG. 6 is an exploded view that shows a clip pair 108 joined by an elastic band 117 that are configured to nest in the clip slots 114 of couplings 106.

FIG. 7 is another exploded view where the elongate members have been omitted. Typically, bands 118 may be used to join couplings 106 to sections of the elongate members.

FIGS. 8A and 8B show respectively, a clip pair 108 joined by an elastic band 117 and a clip pair omitting the band showing the band slot 119 of the clips 108.

Figure 9A:
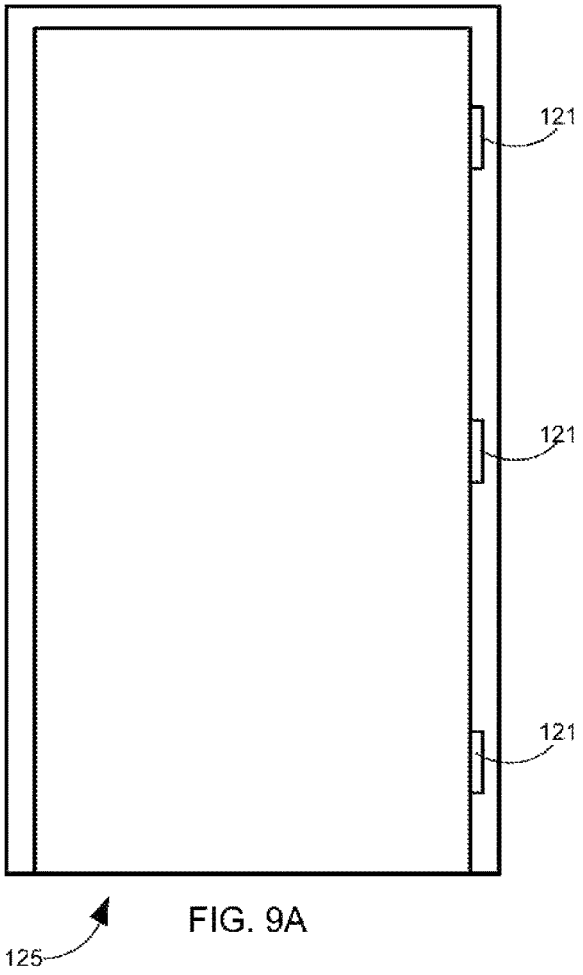
FIG. 9A is a side view of one side of an in-situ door and door frame prior to installation of the hinge guard assembly.
Figure 9B:
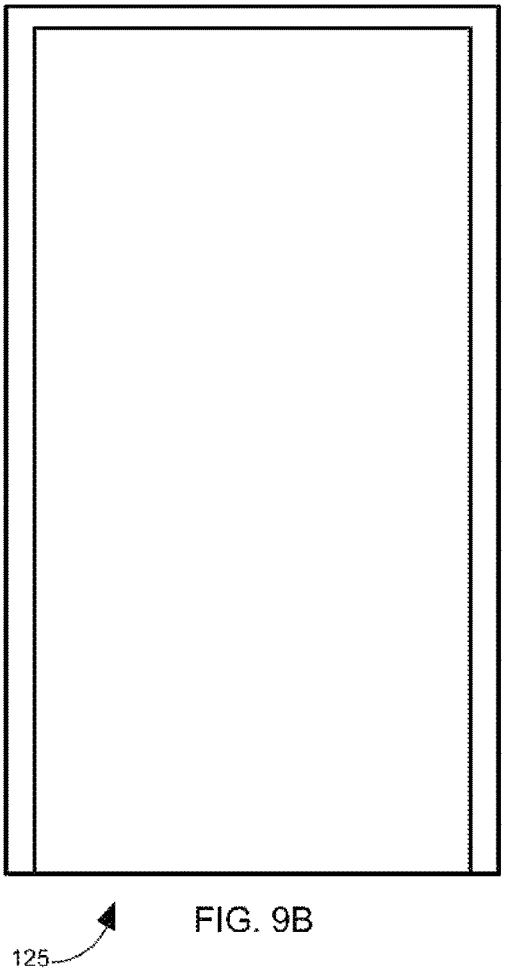
FIG. 9B is an opposite side view thereof.

FIGS. 9A and 9B show respectively, opposite sides of a door frame prior to installation of a hinge stile gap blocker 100.

Figure 10A:
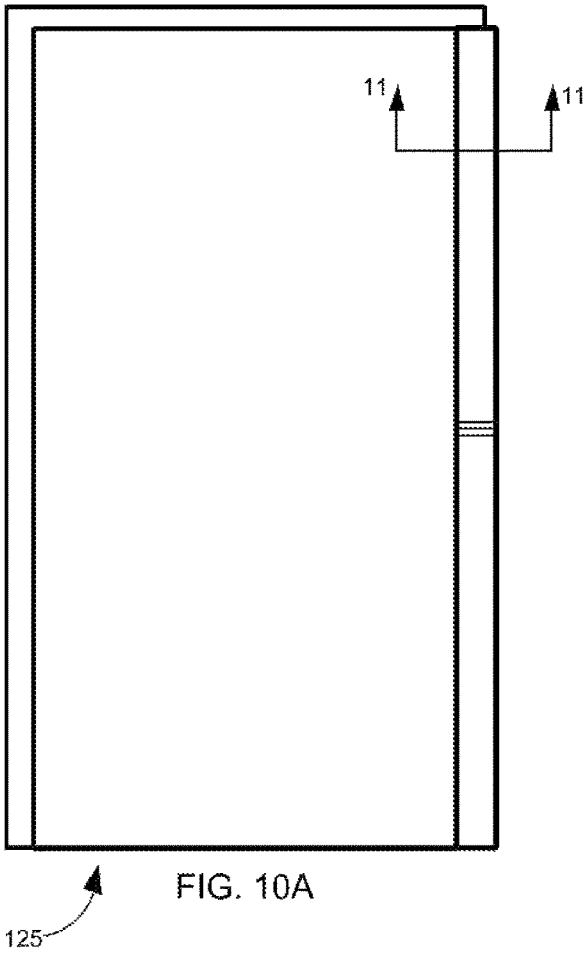
FIG. 10A is a side view of one side of an in-situ door and door frame after installation of the hinge guard assembly.
Figure 10B:
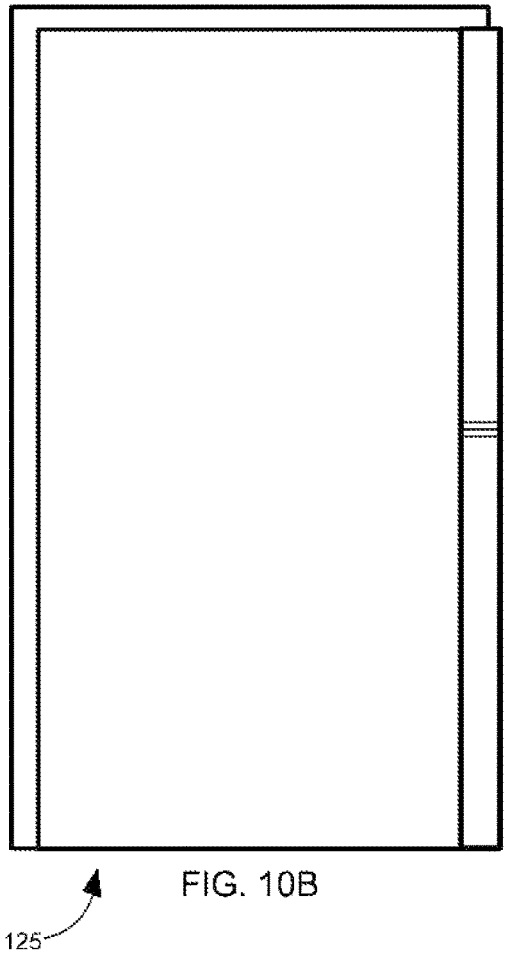
FIG. 10B is an opposite side view thereof.

FIGS. 10A and 10B show respectively, opposite sides of a door frame after installation of a hinge stile gap blocker 100.

Figure 11:
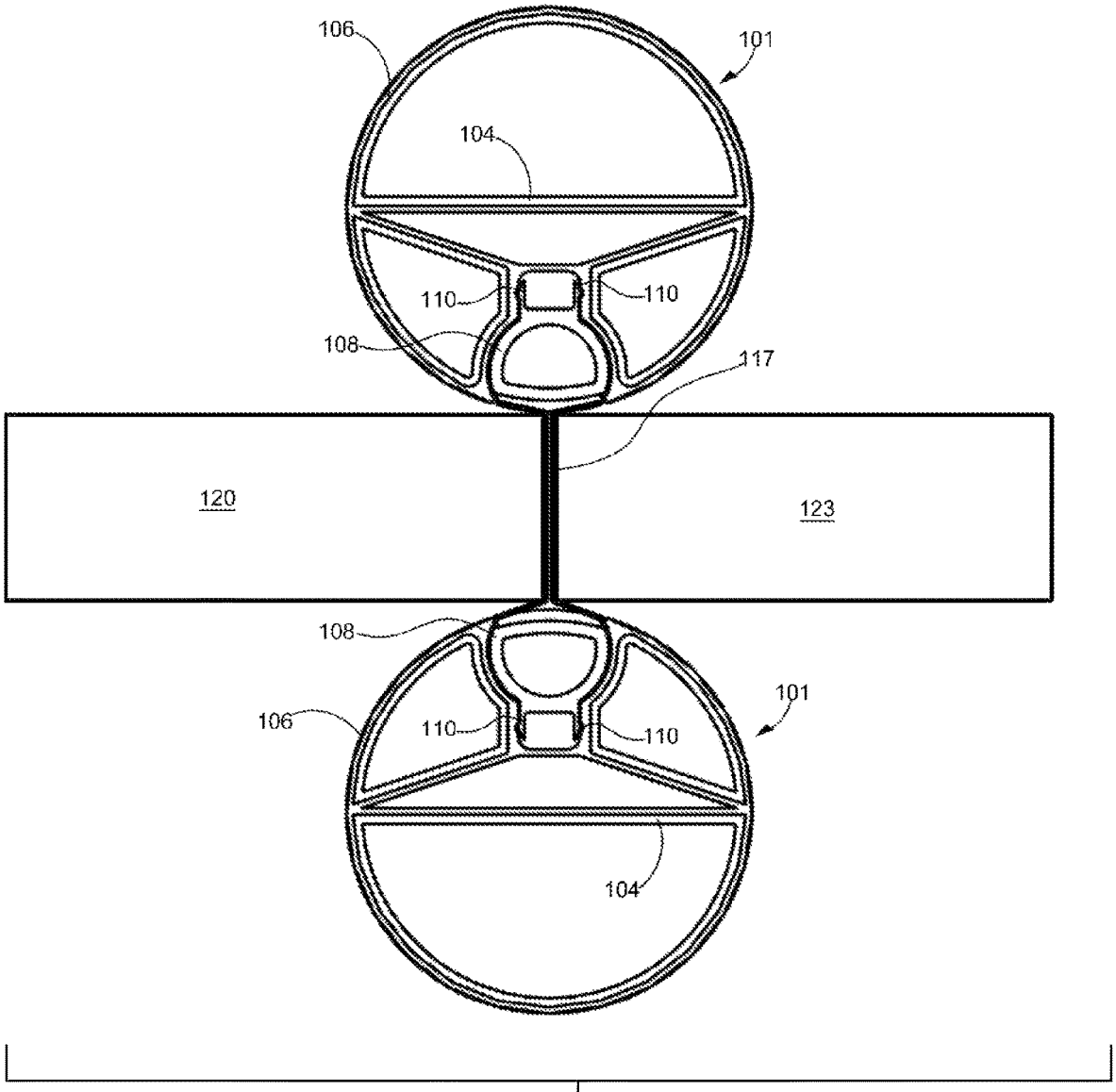
FIG. 11 is a cross-sectional view taken along lines (11-11) of (FIG. 10A)
Figure 12:
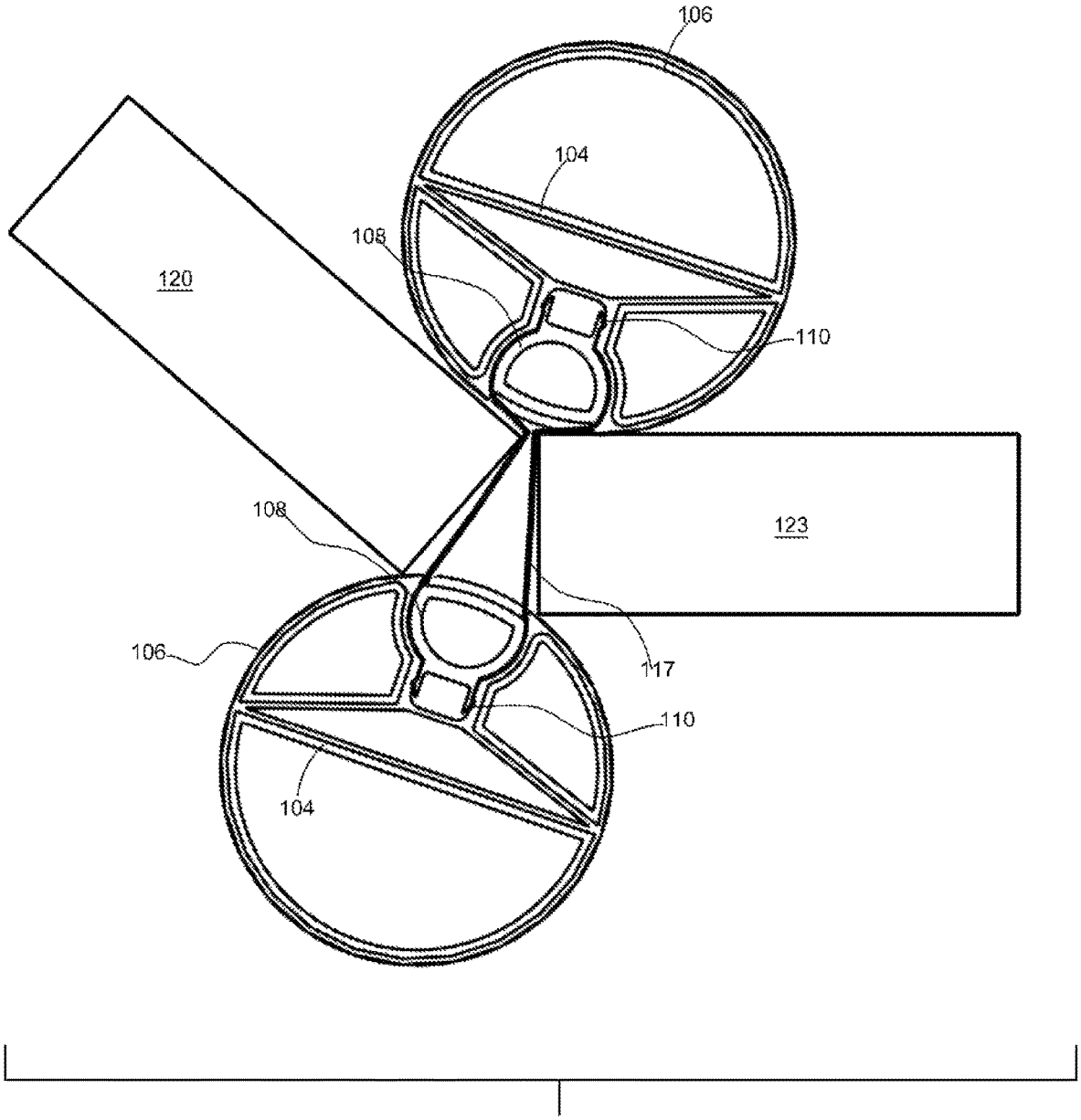
FIG. 12 is another a cross-sectional view thereof showing a possible position of the hinge stile blocking apparatus when the door is pivoted open.
Figure 13:
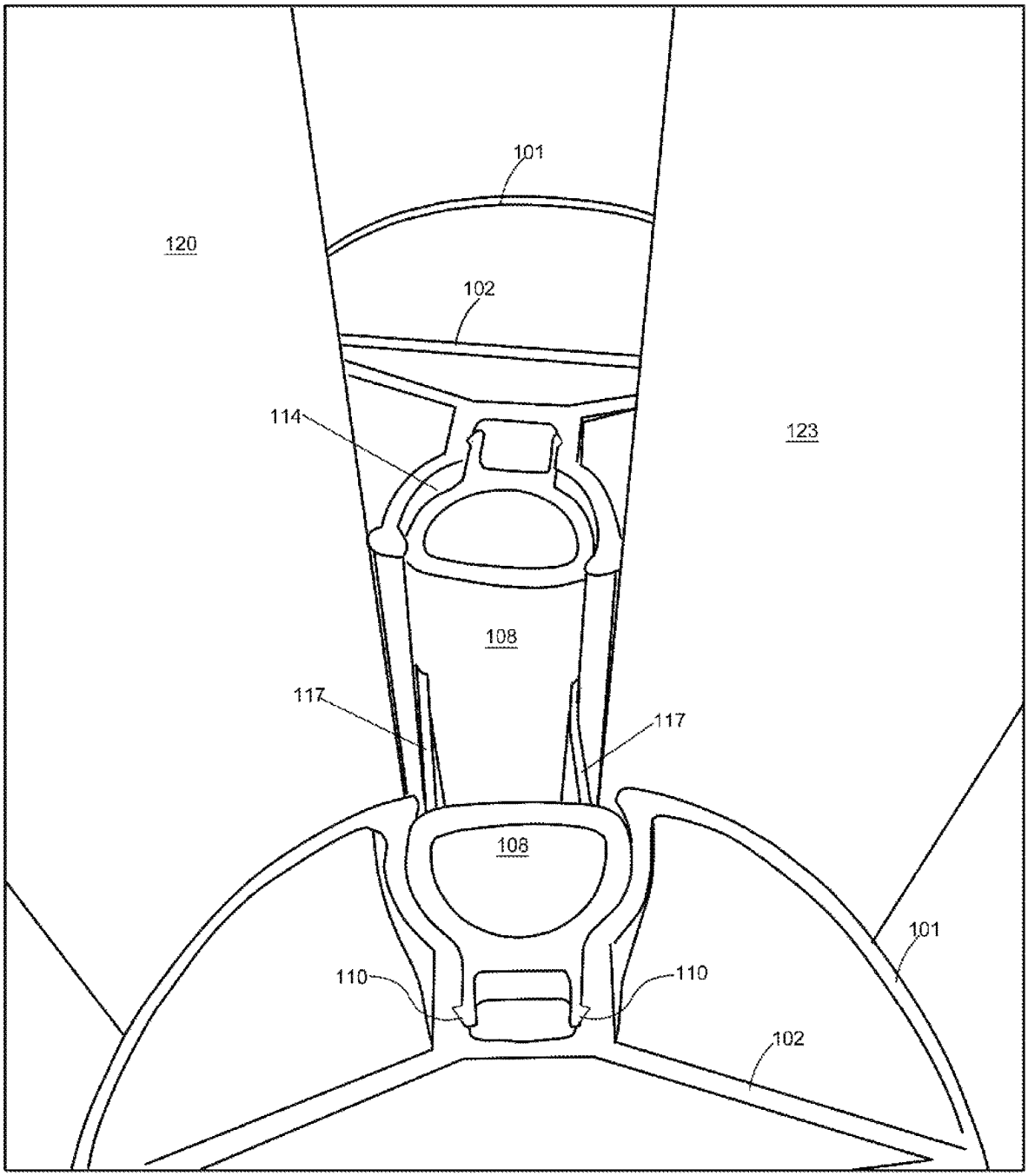
FIG. 13 is a perspective view looking into a hinge stile gap showing the elongate members on either side of the gap joined by an elastic member.

FIGS. 11 and 12 are cross-sectional views of a door frame hinge stile 122 and the elongate members 101 of opposite sides of the hinge stile gap 130.

The following is one exemplary method of installation according to embodiments of the invention:

(1) mounting a first set of annular couplings, each coupling mounted at the intersection of one or more sections of a first elongate member;

(2) at an intersection of the one or more sections, placing a clip member with an elastic band thereover, the clip member inserted into a clip slot of each of the annular couplings;

(3) positioning the first elongate member in a door hinge stile and connecting it to a second elongate member disposed on an opposite side of the door hinge stile by mounting a clip member from a second set of clip members to each annular coupling of a second set of annular couplings mounted to the second elongate member, and looping one of the elastic bands previously mounted to an opposing coupling of the first elongate member to a corresponding clip member of the second elongate member.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the scope of the following claims.

What is claimed is:

1. A door safety apparatus for protecting hands and fingers comprising:

at least one hinge gap blocker assembly including a first elongate member and a second elongate member, the first elongate member and the second elongate member include a longitudinal clip slot shaped to receive a plurality of clip members, each clip member including prong portions and a band slot;

the clip slots include a rectangular channel and the rectangular channel is interlockable with the prong portions of the clip members;

at least one annular coupling adapted to join the first elongate member to the second elongate member;

a plurality of elastic bands adapted for placement over the band slots of the clip members;

the first and second elongate members disposed opposite one another and joined at sections along their lengths by opposite facing pairs of clip members and elastic bands.

* * * * *